United States Patent [19]

Quillfeldt

[11] 4,075,537

[45] Feb. 21, 1978

[54] IGNITION ELECTRODE ARRANGEMENT FOR GAS DISCHARGE LAMPS, PARTICULARLY FOR FLASH TUBES

[75] Inventor: Winfried Quillfeldt, Jena, Germany

[73] Assignee: Jenoptik Jena G.m.b.H., Jena, Germany

[21] Appl. No.: 731,499

[22] Filed: Oct. 13, 1976

[30] Foreign Application Priority Data

Dec. 16, 1975 Germany ..... 190180

[51] Int. Cl.[2] ..... H05B 41/22; H05B 41/32

[52] U.S. Cl. ..... 315/354; 313/198; 313/201; 315/57; 315/234; 315/274; 331/94.5 PE

[58] Field of Search ..... 315/57, 60, 274, 275, 315/234, 335, 354; 331/94.5 PE; 313/166, 198, 201, 234

[56] References Cited

U.S. PATENT DOCUMENTS

| | | | |
|---|---|---|---|
| 2,755,714 | 7/1956 | Germeshausen | 315/234 X |
| 3,582,821 | 1/1971 | Gordon et al. | 331/94.5 PE |
| 4,004,189 | 1/1977 | Cosco et al. | 315/335 |
| 4,010,397 | 3/1977 | Hon | 313/201 X |

*Primary Examiner*—Eugene R. LaRoche

[57] ABSTRACT

The invention concerns an electrode arrangement for improving the ignition readiness of gas discharge lamps, particularly for flash tubes. The ignition electrodes consist of a plurality of wire loops which surround the surface of a gas discharge tube. The mutual space between neighboring wire loops is smaller in the center portion of the tube than towards both end portions.

1 Claim, 2 Drawing Figures

IGNITION ELECTRODE ARRANGEMENT FOR GAS DISCHARGE LAMPS, PARTICULARLY FOR FLASH TUBES

This invention concerns an electrode arrangement for improving the ignition readiness of gas discharge lamps, particularly of flash tubes.

Gas discharge lamps of this kind are, among others, used as pumping light sources in laser arrangements. They produce an inversion of the energy levels in laser active materials which are thus excited to emit a coherent radiation of high intensity.

Most of the present day lasers are provided with commercial xenon flash lamps, which ensure a high radiation output over a broad spectral range and which substantially emit white light. Concerning their design the filament lamp is used, but, above all, the rod shaped lamp construction where a cylindrical discharge tube made of quartz or any other heat resistant material is closely sealed at is end portions, and its interiour is filled with xenon or any other suitable rare gas.

When a sufficiently high voltage is applied across the two electrodes of the discharge tube, the gas discharge is fired.

In order to start the discharging performance preferably a capacitor fed high frequency field ionises the gas discharge path.

So it is known to apply a high frequency auxiliary voltage across the ignition electrodes which are constituted of several wire loops surrounding the discharge tube equally spaced from one another. The ignition electrode ensures a progressive discharge until the entire gas between the two electrodes is ignited.

The distance between neighbouring wire loops conventionally is about 10 to 15 millimeters.

The ignition readiness, that is, the value of the voltage threshold across the electrodes at which the discharge takes place, decisively determines the quality of a gas discharge lamp, its life and its range of application. It is an object of the present invention to improve the quality of gas discharge lamps, particularly of flash tubes, to increase their life and to broaden the range of usage.

It is a further object of the present invention to provide an ignition electrode arrangement which improves the ignition readiness of gas discharge lamps.

Accordingly, the invention consists in an arrangement of a plurality of adjacently located wire loops surrounding the surface of a gas discharge tube wherein the distance between neighbouring wire loops is smaller in the center portion of the gas discharge tube than in the range of the two electrodes provided at the end portions of the tubes.

Figure 1:
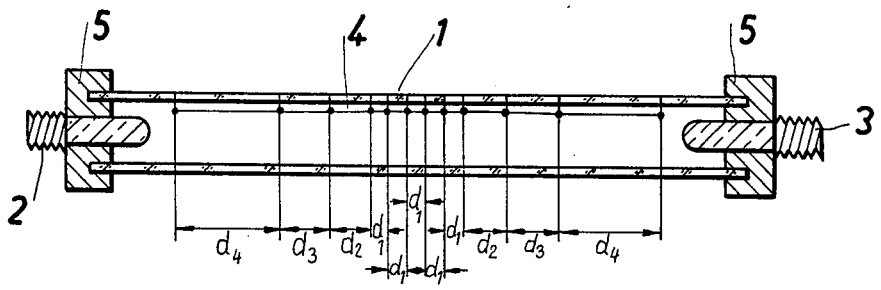

In order that the invention may be more readily understood reference is made to the accompanying drawings which illustrate diagrammatically and by way of example one embodiment thereof and in which:

FIG. 1 is a schematical view of a discharge arrangement, and

Figure 2:
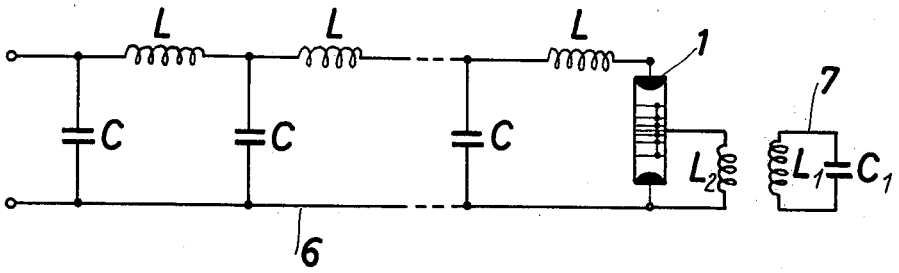

FIG. 2 a schematical view of a current supply circuit.

A cylindrical gas discharge tube 1, made of quartz and filled with xenon gas under a pressure of about 500

Torr (50 centimeters of mercury) is closely sealed at its end portions by gaskets 5 and provided with electrodes 2 and 3.

The discharge tube has a diameter of 10 millimeters and the opposing electrodes 2 and 3 are spaced apart at about 75 millimeters.

A number of wire loops 4, made, for example, of tungsten surround the discharge tube 1 as ignition electrodes.

The wire diameter is about 0.2 millimeters.

The distance $d_1$ between the neighbouring wire loops is $\leqq$ 2 millimeters in the centre portion of the tube 1. The distances between the subsequent wire loops gradually increase towards the end portions of the tube 1 from $d_2 \approx 5$ mm, $d_3 \approx 10$ mm to $d_4 > 10$ mm.

The gas discharge lamp is current supplied via a delay line 6 constituted of discrete inductivities L and capacitors C.

The potential across the electrodes 2, 3 is less than 0.5 kilovolts, the peak voltage about 1 kilovolt. To fire the gas discharge tube 1, a high frequency pulse of about 15 to 20 kilovolts, at a frequency of $f \approx$ 1 megacycles is fed into the ignition electrodes 4. The pulse is derived from an ignition circuit including the inductivity $L_1$ and the capacity $C_1$ via the inductivity $L_2$.

In the discharge tube 1 a spark discharge takes place which starts from the wire loops 4 surrounding the tube 1. The sparks provoke a discharge between the electrodes 2 and 3, in the event that a spark channel forms from the one electrode to the other electrode.

The operation voltage applied across the electrodes 2, 3 promotes the formation of such a spark channel.

When the wire loops 4 are in a close sequence in the center portion of the discharge tube, when, in other words, the space between the neighbouring loops in the centre portion is small compared to the space between neighbouring loops at the end portions, then the spark formation starts in the center portion of the discharge tube 1 and even at a comparatively low voltage a spark channel forms, which in turn, fires the discharge path.

Apart from an improvement of the ignition readiness, the inventional arrangement favorably affects the life time of gas discharge lamps.

I claim:

1. An electrode arrangement for improving the ignition readiness of gas discharge lamps, particularly of flash tubes comprising a gas discharge tube, being filled with a rare gas, at least two electrodes, either of said electrodes being provided at the end portions of said tube, a plurality of wire loops surrounding the surface of said tube, a current supply unit, connected to said electrodes, and to said wire loops said wire loops being employed as ignition electrode, said wire loops being mutually spaced from one another at a distance which is smaller in the center portion of said tube than towards said end portions, said current supply unit feeding ignition pulses into said wire loops.

* * * * *